US007462991B2

(12) United States Patent
Tremblay et al.

(10) Patent No.: US 7,462,991 B2
(45) Date of Patent: Dec. 9, 2008

(54) FLUORESCENT LAMP CATHODE AND METHOD OF MAKING CATHODES

(75) Inventors: Bruce R. Tremblay, Minot, ME (US); Kevin L. McLoughlin, Auburn, ME (US)

(73) Assignee: Elmet Technologies, Inc., Lewiston, ME (US)

( * ) Notice: Subject to any disclaimer, the term of this patent is extended or adjusted under 35 U.S.C. 154(b) by 433 days.

(21) Appl. No.: 11/059,405

(22) Filed: Feb. 16, 2005

(65) Prior Publication Data

US 2006/0181217 A1 Aug. 17, 2006

(51) Int. Cl.

| | |
|---|---|
| ***H01J 17/04*** | (2006.01) |
| ***H01J 9/04*** | (2006.01) |
| ***H01J 9/12*** | (2006.01) |
| ***H01K 1/14*** | (2006.01) |

(52) U.S. Cl. ..... 313/632; 313/631; 313/344; 445/48; 445/49

(58) Field of Classification Search ..... 313/631–632, 313/271, 493, 491, 346 R, 344, 345, 333, 313/343, 339; 445/48–51
See application file for complete search history.

(56) References Cited

U.S. PATENT DOCUMENTS

| | | | |
|---|---|---|---|
| 3,725,720 | A | 4/1973 | Petro et al. |
| 3,778,664 | A | 12/1973 | Petro et al. |
| 3,792,244 | A | 2/1974 | Petro et al. |
| 3,822,455 | A | 7/1974 | Petro et al. |
| 4,506,187 | A | 3/1985 | Hofmann et al. |
| 5,742,125 | A | 4/1998 | Ruigrok et al. |
| 5,777,435 | A | 7/1998 | Claassen et al. |
| 6,809,477 | B2 | 10/2004 | Soules et al. |

*Primary Examiner*—Sikha Roy
*Assistant Examiner*—Anne M Hines
(74) *Attorney, Agent, or Firm*—Preti Flaherty Beliveau & Pachios LLP

(57) ABSTRACT

A method of making cathodes includes forming a first intermediate assembly having a current wire in juxtaposition with an outer mandrel wire and a basket wire wound around the first two wires. The first intermediate assembly is wound around a central mandrel to form a second intermediate assembly. Pulses of energy are used to produce an alloy solder joint between the current wire and the basket wire at selected locations. The second intermediate assembly is cut into segments, and the mandrels are removed. This results in a cathode having a coiled current wire and a basket wire wound around the current wire, with the basket wire being bonded to the current wire by the alloy solder joints. The cathode includes a central bore that is substantially free of the alloy solder joint.

14 Claims, 3 Drawing Sheets

FLUORESCENT LAMP CATHODE AND METHOD OF MAKING CATHODES

BACKGROUND OF THE INVENTION

This invention relates generally to fluorescent lamps and more particularly to cathodes used in fluorescent lamps.

Fluorescent lamps include a sealed glass tube that contains a small amount of mercury and an inert gas, such as argon, neon or the like, kept under very low pressure. The inside surface of the glass tube is coated with a phosphor powder that fluoresces when excited. A typical fluorescent lamp has a cathode (also referred to as a coil or an electrode) mounted inside the tube at each end thereof, although single-ended lamps are also known. The cathodes are coated with an emitter material that emits electrons during lamp operation. When the lamp is on, alternating current flows through the cathodes producing a voltage across the cathodes. This causes electrons to migrate through the gas from one end of the tube to the other. These electrons collide with mercury atoms, causing the mercury atoms to be ionized and excited. When the mercury atoms return to their normal state, photons corresponding to mercury spectral lines in both the visible and ultraviolet region are generated, thereby exciting the phosphor coating on the inside of the tube to luminance.

Cathodes for fluorescent lamps typically comprise a coiled current wire and a basket wire loosely wound around the current wire. Both the current and basket wires are made of a suitable refractory material, particularly tungsten. The current wire, typically the thicker of the two wires, carries the current that passes through the cathode during operation. The basket wire is provided only to facilitate holding the emitter material in place on the cathode. Current flowing through the current wire causes the current wire to heat up, which in turn heats the emitter material to induce the emission of electrons.

Such cathodes traditionally have been manufactured by winding the wires around steel or iron mandrels and mechanically cutting the resulting wire assembly into segments of the desired length. The mandrels are removed by chemically dissolving them in an acid bath, leaving the coiled current and basket wires. Although the basket wire is wound around the current wire, the two wires are usually further connected to prevent separation while being handled in the lamp assembly process. The cathode is then covered with the emitter material, which is typically applied in slurry form.

Known ways of attaching the basket wire to the current wire include mechanical crimping, in which the basket wire is crimped or deformed against the current wire. This crimp does not metallurgically bond the two wires together, and as a result, the crimp will often let go as the finished part is handled, allowing the wires to separate. Crimped cathodes are also highly susceptible to tangling with other cathodes when stored together in a container. That is, without extreme care in the manufacturing process excessive burring can occur on the ends of the finished cathodes. These burrs tend to become entangled with the coil turns of other cathodes. This tangling makes it difficult to remove individual cathodes from the container during fluorescent lamp assembly operations.

A solution to this tangling problem is to attach the basket wire to the current wire by using a laser or plasma process to melt the full ends of the cathode, including the center steel mandrel. This forms a globular amalgam or "ball" of tungsten-iron alloy that encapsulates the basket wire and the current wire at each end of the cathode. This tungsten-iron alloy does not dissolve in the subsequent dissolving process and thus remains to secure the cathode ends. The resultant "balled-end" cathode is very resistant to tangling. However, this process requires machinery to accurately position the wire assembly in front of a laser or plasma source. While energy is applied to melt the cathode end, the wire assembly is essentially stopped to allow enough time for the material to melt sufficiently to form the large ball of the tungsten-iron alloy. This indexing is a significant limiting factor to machine throughput. In addition, a balled-end cathode results in a large portion of the product having excess retained alloy. Typically the ball of the tungsten-iron alloy consumes over 20% of the usable area.

Accordingly, there is a need for a tangle resistant fluorescent lamp cathode that can be fabricated more efficiently than balled-end cathodes.

SUMMARY OF THE INVENTION

The above-mentioned need is met by the present invention, which provides a method of making a cathode that includes forming a first intermediate assembly having a current wire in juxtaposition with an outer mandrel wire and a basket wire wound around the juxtaposed current wire and outer mandrel wire. The first intermediate assembly is wound around a central mandrel to form a second intermediate assembly. Selected locations on the second intermediate assembly are subjected to pulses of energy so as to partially melt the current wire, the basket wire and the outer mandrel wire and thus produce an alloy solder joint between the current wire and the basket wire at the selected locations. The second intermediate assembly is cut into a number of segments, and the segments are treated to remove the outer mandrel wire and the central mandrel.

This results in a cathode having a coiled current wire and a basket wire wound around the current wire, with the basket wire being bonded to the current wire at one or more locations by an alloy solder joint between the current wire and the basket wire. The cathode includes a central bore that is substantially free of the alloy solder joint.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
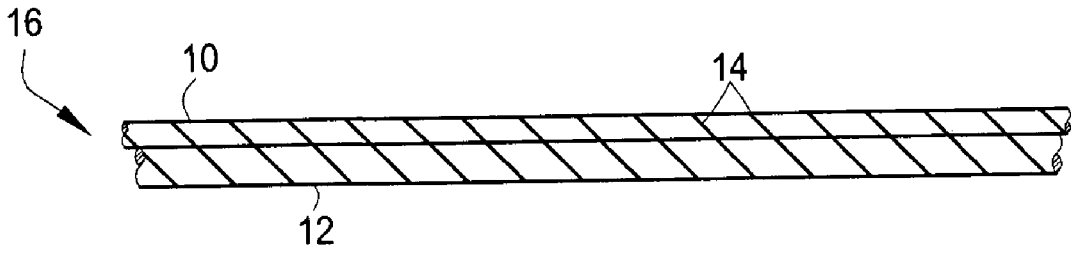
FIG. 1 is a side view of a first intermediate assembly used in making a fluorescent lamp cathode.
Figure 2:
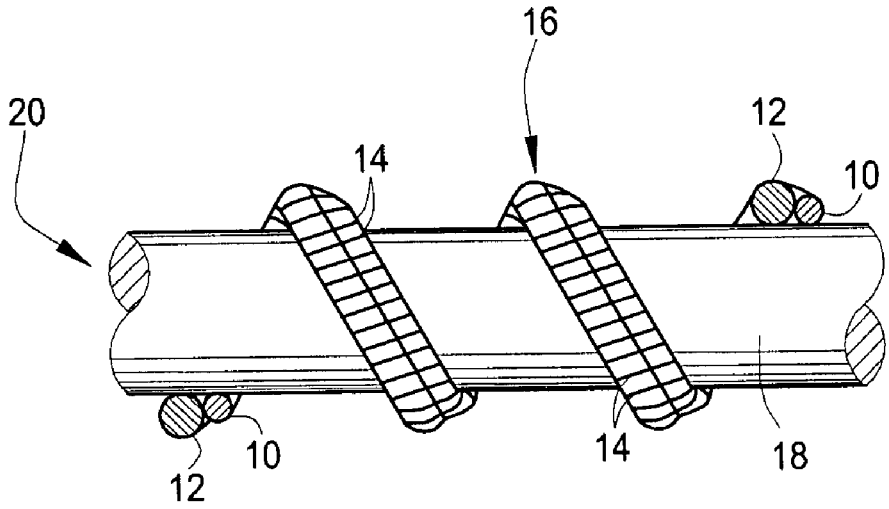
FIG. 2 is a side view of a second intermediate assembly used in making a fluorescent lamp cathode.
Figure 3:
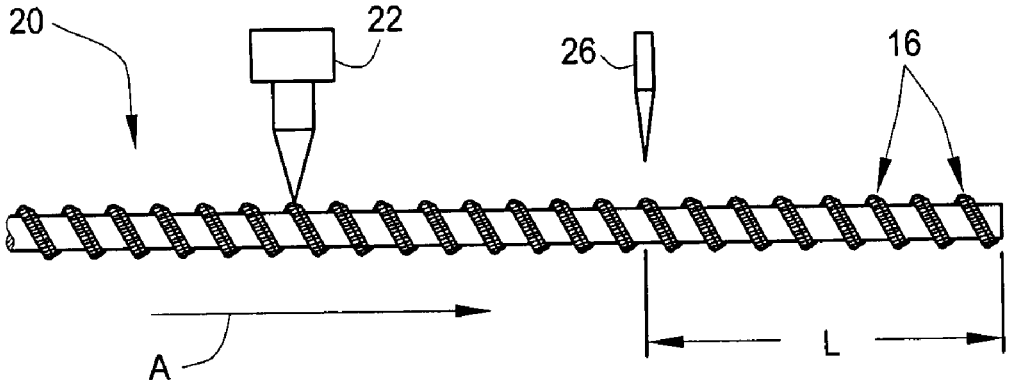
FIG. 3 is a schematic view showing the bonding and cutting operations for a method of making fluorescent lamp cathodes.

Referring to the drawings wherein identical reference numerals denote the same elements throughout the various views, FIGS. 1-3 illustrate one embodiment of a method of manufacturing tangle resistant cathodes for fluorescent lamps. Turning first to FIG. 1, a current wire 10 is placed in juxtaposition with an outer mandrel wire 12; that is, the two wires 10 and 12 are arranged in side-to-side engagement, extending lengthwise in the same direction. The current wire 10, which will be the current-carrying component of the finished cathode, is made of a suitable refractory material, typically tungsten. The outer mandrel wire 12 is ductile wire made of a dissimilar material that is capable of being chemically dissolved. Suitable mandrel materials include steel and iron. The outer mandrel wire 12 is preferably, but not necessarily, slightly thicker than the current wire 10. A basket wire 14 is then tightly wound around the paired current wire 10 and outer mandrel wire 12 to form a first intermediate assembly 16. Like the current wire 10, the basket wire 14 is made of a suitable refractory material, typically tungsten, and will become a component of the finished cathode. The current wire 10 is typically thicker than the basket wire 14.

Next, the first intermediate assembly 16 is wound around a central mandrel 18 to form a second intermediate assembly 20, as shown in FIG. 2. The central mandrel 18 is also made of a material that is capable of being chemically dissolved, such as steel or iron. However, the central mandrel 18 is substantially thicker than the outer mandrel wire 12.

Figure 4:
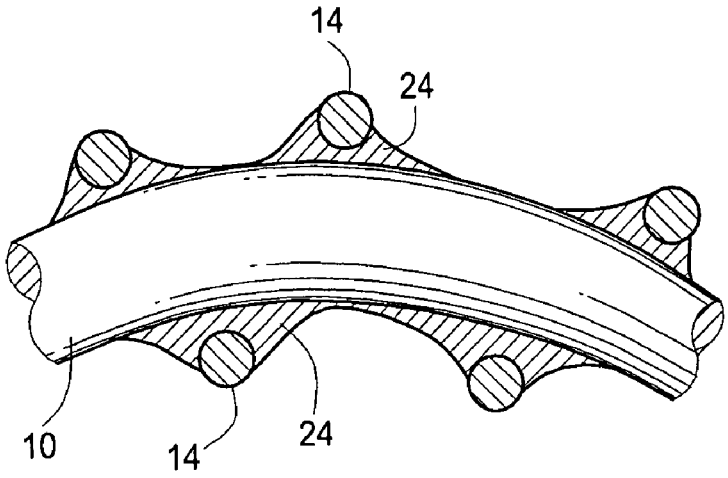
FIG. 4 is an enlarged, cross-sectional view of a portion of a fluorescent lamp cathode.

The next step is to metallurgically bond the current wire 10 and the basket wire 14 together at selected locations spaced along the length of the second intermediate assembly 20. These bonding locations are spaced apart at a uniform distance that is equal to the desired length for the finished cathodes. As shown in FIG. 3, the second intermediate assembly 20 is advanced longitudinally (as indicated by arrow A) past an energy source 22 that is pulsed at a predetermined frequency to apply a high-energy pulse to the uniformly spaced bonding locations on the second intermediate assembly 20. The energy pulse is a short, powerful pulse that partially melts the current wire 10, the basket wire 14 and the outer mandrel wire 12 to produce an alloy (e.g., a tungsten-iron alloy when using tungsten current and basket wires and steel mandrel wire) that wicks between the current wire 10 and the basket wire 14 to bond these wires together at the desired locations along the second intermediate assembly 20. In the finished cathode, these bonds prevent the basket wire 14 from unraveling from the current wire 10, and dramatically reduce the finished cathode's ability to tangle. The energy pulse is of short enough duration so as to keep the center mandrel 18 essentially intact (i.e., the central mandrel 18 experiences very little or no melting due to the energy pulse) and melts only the current wire 10, the basket wire 14 and the outer mandrel wire 12. This causes the tungsten-iron alloy to form at the current wire 10 and the basket wire 14 only. Unlike the prior art balled-end cathode, there is no globular end because the center mandrel 18 undergoes very little or no melting. Instead of a globular or balled end, there is only a bit of wetting of tungsten-iron alloy between the current wire 10 and the basket wire 14, defining an alloy solder joint 24, as shown in FIG. 4. Specifically, the alloy solder joint 24 does not extend across the entire width of the second intermediate assembly 20.

The energy source 22 emits a pulsed beam of energy that is directed onto the second intermediate assembly 20. The beam is preferably, although not necessarily, focused so as to be just slightly bigger than the width of the second intermediate assembly 20 to facilitate heat distribution. While a variety of energy sources, such as a focused electron beam, a plasma torch or an oxy-hydrogen flame, could be used, a laser is a preferred energy source 22 because it can be controlled and focused with great accuracy. One suitable laser is a pulsed Nd:YAG solid state fiber optic laser. In this case, the laser 22 is energized to produce pulses of about 4-6 milliseconds in duration and total power of in the range of about 7-15 joules per pulse. It has been found that in producing 32-40 watt cathodes with tungsten current and basket wires and steel mandrels, using laser pulses of 12 joules over 6 milliseconds provides excellent bonding results without excessive amounts of alloy.

Utilizing high energy, short duration pulses from the energy source 22 assures that the energy only penetrates the outer surface of the second intermediate assembly 20, thereby locally melting the current wire 10, the basket wire 14 and the outer mandrel wire 12, but not the central mandrel 18. The short pulse duration also permits a continuous, high-speed feed of the second intermediate assembly 20 during the bonding operation (and a subsequent cutting operation to be described below), instead of being indexed and stopped during bonding. That is, the intermediate assembly 20 is moved continuously while the energy source 22 is periodically pulsed to produce energy pulses that impinge the second intermediate assembly 20 at the uniformly spaced bonding locations. The frequency at which the energy source 22 is pulsed is correlated to the speed of the second intermediate assembly 20 so that the bonding locations are spaced apart a distance equal to the desired length of the finished cathodes. The continuous, high-speed feed of the second intermediate assembly 20 enables much higher processing speeds, which greatly enhances efficiency and throughput.

Referring again to FIG. 3, the second intermediate assembly 20 is mechanically cut at each bonding location after the bonding operation. This can be accomplished by continuing to advance the second intermediate assembly 20 past a mechanical cutter 26 (typically a knife blade) that is located downstream of the energy source 22. The second intermediate assembly 20 is cut at each bonding location by the cutter 26 to produce individual segments of desired length L. When cutting the second intermediate assembly 20 at the bonding locations, the cutter 26 severs the alloy solder joints 24 so that a portion of each joint ends up on each side of the cut. The cutter 26 is operated at a frequency that is synchronous with the pulse frequency so that the cutting will occur at previously formed bonding locations on the continuously moving second intermediate assembly 20. The pulse and cutting frequencies can be synchronized with a computerized servo system, which provides precision control and allows for a variety of cut lengths as well as fine cut length adjustments. Other types of control systems, such as a cam operated mechanism, could alternatively be used. The energy source 22 and the cutter 26 are preferably spaced apart a sufficient distance (which is typically in the range of about 3-5 times the length L) so that each bonding location is cool enough when it reaches the cutter 26 that the cutter 26 can cut the second intermediate assembly 20 without the possibility of individual segments sticking together from molten material.

The next step is to remove the outer mandrel wire and central mandrel sections from the individual segments. This can be done by placing the cut segments into an acid bath that chemically dissolves the outer mandrel wire 12 and the central mandrel 18. During the dissolving process, the alloy solder joint 24, which as previously mentioned can be a tungsten-iron alloy, does not get dissolved and remains to bond the basket wire 14 to the current wire 10. After the dissolving operation, the segments are washed and dried and then coated with a suitable emitter material, such as a barium oxide mixture, to produce a finished cathode. The emitter material, which can be applied by dipping the segments into a slurry of emitter material, fills the spaces created by the loose coil of the basket wire 14.

Figure 5:
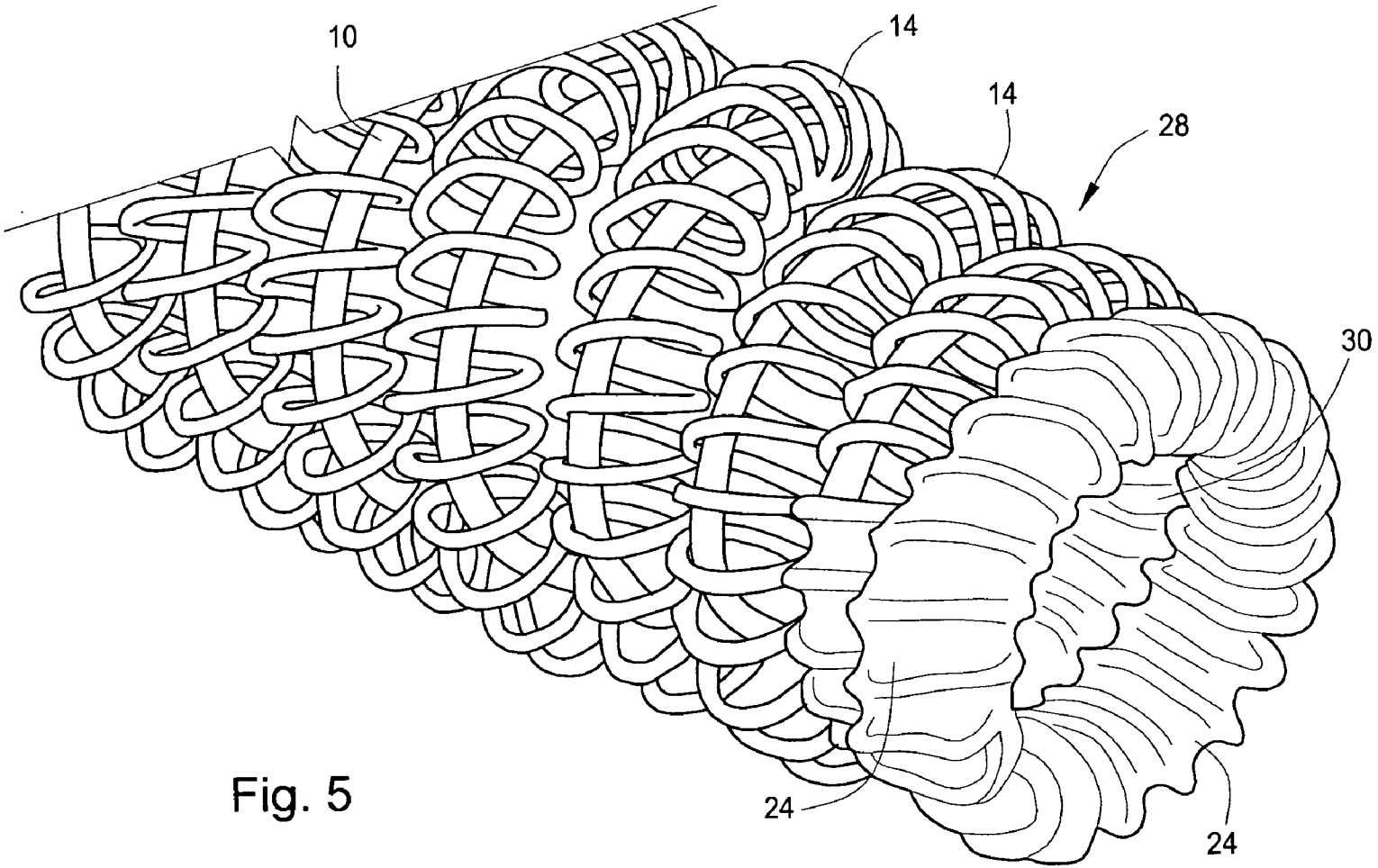
FIG. 5 is an enlarged, partial perspective view of a fluorescent lamp cathode.

A finished cathode 28 produced by the above-described method is shown in FIG. 5. The cathode 28 has a coiled current wire 10 and a basket wire 14 loosely coiled around the current wire 10. The basket wire 14 is metallurgically bonded to the current wire 10 at both ends of the cathode 28 (only one end shown in FIG. 5) by an alloy solder joint 24. The turns of the cathode wire 10 are substantially equal in diameter such that the cathode 28 has a substantially linear configuration in the lengthwise direction. When viewed from an end, the cathode 28 has an annular or "barrel" configuration defining a central bore 30 extending the entire length of the cathode 28. The bore 30 is the space occupied by the central mandrel 18 prior to the dissolving operation and is essentially open space. The alloy solder joints 24 do not extend across the ends of the cathode 28 or into the central bore 30. This results in an open-ended cathode, instead of the closed ends of the prior art balled-end cathodes.

While specific embodiments of the present invention have been described, it will be apparent to those skilled in the art that various modifications thereto can be made without departing from the spirit and scope of the invention as defined in the appended claims.

What is claimed is:

1. A method of making a cathode comprising:

placing a current wire in juxtaposition with an outer mandrel wire;

winding a basket wire around said juxtaposed current wire and outer mandrel wire to form a first intermediate assembly;

winding said first intermediate assembly around a central mandrel to form a second intermediate assembly;

subjecting selected locations on said second intermediate assembly with pulses of energy so as to partially melt said current wire, said basket wire and said outer mandrel wire and produce an alloy solder joint between said current wire and said basket wire at said selected locations cutting said second intermediate assembly into a number of segments; and removing said outer mandrel wire and said central mandrel from each segment, thereby defining an open-ended central bore in each segment that is substantially free of said alloy solder joint.

2. The method of claim 1 wherein said pulses of energy are laser beams.

3. The method of claim 1 wherein said pulses of energy cause little or no melting of said central mandrel.

4. The method of claim 1 wherein said second intermediate assembly is moved continuously while subjecting said second intermediate assembly to said pulses of energy.

5. The method of claim 1 wherein said selected locations are spaced apart at a uniform distance that is equal to a desired length for said cathode.

6. The method of claim 5 wherein said second intermediate assembly is cut at said selected locations.

7. The method of claim 1 wherein said outer mandrel wire and said central mandrel are removed by being chemically dissolved.

8. The method of claim 1 wherein said current wire and said basket wire are made of tungsten and said outer mandrel wire and said central mandrel are made of steel.

9. The method of claim 1 wherein each pulse of energy has a duration of about 4-6 milliseconds and a total power of about 7-15 joules.

10. A cathode comprising:

a coiled current wire; and a basket wire wound around said current wire, said basket wire being bonded to said current wire at one or more locations by an alloy solder joint between said current wire and said basket wire;

wherein said current wire and said basket wire are configured to define a central bore that extends the entire length of said cathode and is substantially free of said alloy solder joint.

11. The cathode of claim 10 wherein said current wire and said basket wire are made of tungsten.

12. The cathode of claim 11 wherein each alloy solder joint comprises a tungsten-iron alloy.

13. The cathode of claim 10 wherein said basket wire is bonded to said current wire by an alloy solder joint at each end of said cathode.

14. The cathode of claim 13 wherein said alloy solder joints do not extend across said ends of said cathode.

* * * * *